US009694270B2

(12) United States Patent
Granger

(10) Patent No.: US 9,694,270 B2
(45) Date of Patent: Jul. 4, 2017

(54) SKATE BLADE FOR BALANCE AND PERFORMING SKATING SKILLS

(71) Applicant: Colin Edward Granger, Port Perry (CA)

(72) Inventor: Colin Edward Granger, Port Perry (CA)

( * ) Notice: Subject to any disclaimer, the term of this patent is extended or adjusted under 35 U.S.C. 154(b) by 0 days.

(21) Appl. No.: 14/637,199

(22) Filed: Mar. 3, 2015

(65) Prior Publication Data

US 2016/0256764 A1 Sep. 8, 2016

(51) Int. Cl.

| | |
|---|---|
| ***A63C 1/00*** | (2006.01) |
| ***A63C 1/30*** | (2006.01) |
| ***A63C 1/32*** | (2006.01) |
| ***A63C 3/08*** | (2006.01) |

(52) U.S. Cl.
CPC . *A63C 1/32* (2013.01); *A63C 3/08* (2013.01)

(58) Field of Classification Search
CPC ..... A63C 1/00; A63C 1/30; A63C 1/32
See application file for complete search history.

(56) References Cited

U.S. PATENT DOCUMENTS

| | | | | | |
|---|---|---|---|---|---|
| 40,921 | A * | 12/1863 | Feurstein | A63C 1/30 | 280/11.12 |
| 334,954 | A * | 1/1886 | Kingston | A63C 1/00 | 280/11.31 |
| 997,030 | A * | 7/1911 | Adler | A63C 1/32 | 280/11.18 |
| 1,249,115 | A * | 12/1917 | Kessler | A63C 1/32 | 280/11.18 |
| 2,909,375 | A * | 10/1959 | Warner | A63C 17/22 | 280/11.204 |
| 3,552,746 | A * | 1/1971 | Nagin | A63C 17/18 | 280/11.12 |
| 3,558,149 | A * | 1/1971 | Weidenbacker | A63C 1/30 | 280/11.12 |
| 4,218,069 | A * | 8/1980 | Baikie | A63C 1/02 | 280/11.12 |
| 4,418,928 | A * | 12/1983 | Cox | A63C 1/36 | 280/11.14 |
| 8,056,907 | B2 * | 11/2011 | Wilson | A63C 1/32 | 280/11.12 |
| 2014/0327217 | A1 * | 11/2014 | Pokupec | A63C 1/32 | 280/11.18 |

* cited by examiner

*Primary Examiner* — Bryan Evans
(74) *Attorney, Agent, or Firm* — Eugene Gierczak; Miller Thomson LLP

(57) ABSTRACT

The present invention is an ice-skate blade formed to increase the balance of a skater upon an ice-skate blade. The blade may incorporate indentations in one or more both of the following position: a portion of the front section of the skate blade; and a portion of the rear section of the skate blade. Such indentations may be a series of serrated cuts or otherwise formed notches in the lower blade edge. The blade may be formed in a variety of sizes, and may be connectable to a variety of skate boots. A skater utilizing the blade of the present invention will be assisted with regaining balance upon the blade upon experiencing unbalance, and assisted with maintaining balance upon the skate blade. The blade functions in a manner that allows a skater to learn and develop skating skills.

18 Claims, 4 Drawing Sheets

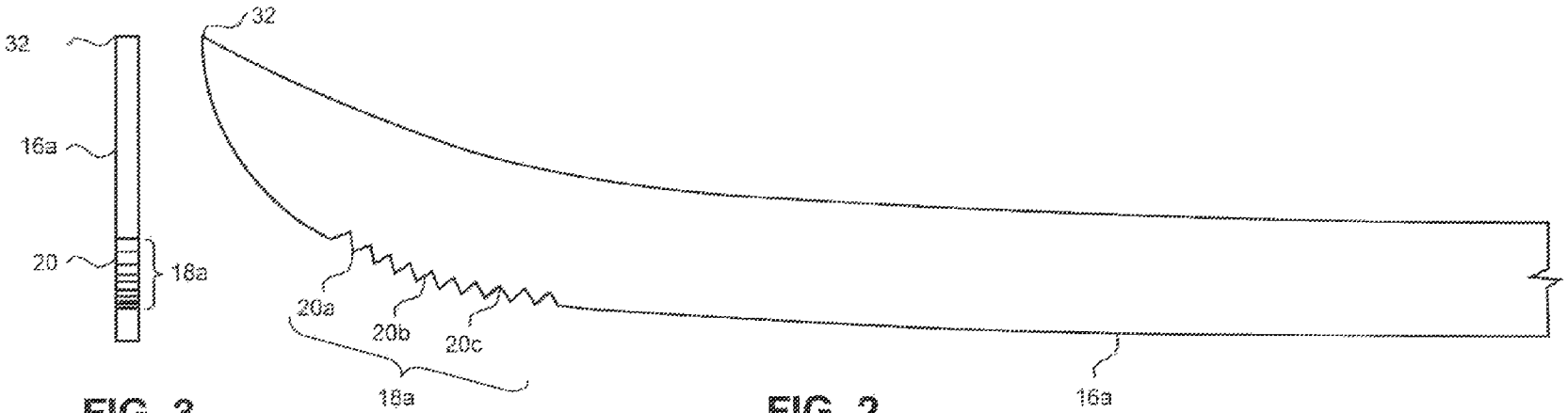
FIG. 2
FIG. 3
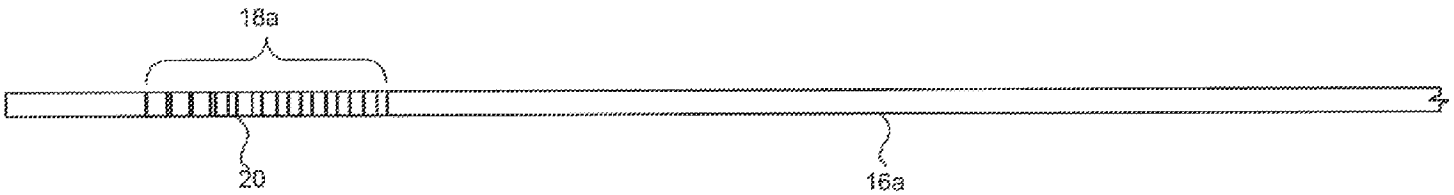
FIG. 4

SKATE BLADE FOR BALANCE AND PERFORMING SKATING SKILLS

FIELD OF INVENTION

This invention relates in general to the field of ice-skate blades and more particularly to a stabilizing ice-skate blade that can be utilized to perform skating skills.

BACKGROUND OF THE INVENTION

A primary issue for ice skaters is attaining stability upon an ice-skate blade. Injuries can occur if a skater is not balanced upon the blades attached to skate boots worn by the skater. In particular, young children can be injured if they are not balanced on the blades of their ice skates. For example, during the period from 2000-2002 in Canada 10.4% of ice and snow sports injuries occurred as a result of ice skating, and 84% of these injuries occurred in children and youth 5-14 years of age. In the province of Ontario, Canada during the period from 2004-2005 there were 5,102 emergency department visits and 283 hospitalizations due to ice-skating related injuries.

Several prior art inventions have been created to address the stability of a skater. For example, slideable structures that can be held onto by a skater while they are skating on the ice surface have been developed.

There are also a number of configurations of ice-skating blades that have been created for a variety of purposes relating to ice-skating. The following are examples of other existing prior art ice-skating blades.

Inventors have configured skates having two parallel blades, an example of this type of prior art is the bob skate. Some versions of bob skates can be strapped onto shoes or boots. This prior art is intended to assist the stability of a beginner skater by offering two blades on each skate to prevent a beginner skater from being required to balance upon a single blade. Such prior art is not utilizable for the purpose of a skater performing skating skills.

Skateez, a product of a PTX Performance Products, a Canadian company, is an attachment that is connected to the boot of a skate. Once so connected, a stabilizing piece extends downwards from either side of the skate boot to be virtually parallel with the skate blade. The stabilizing pieces act in a similar manner to training wheels on a bicycle. If a skater leans too far to the left or to the right the stabilizing piece extending on the side towards which the skater is leaning will make contact with the ice surface and is expected to prevent the skater's lean from increasing. However, when either stabilizing piece comes into contact with the ice surface the skater may be likely to experience increased imbalance and stability issues as the contact of the stabilizing piece with the ice may impede the flow of the gliding of the skater upon their skates. Unlike a training wheel on a bike that is configured to roll when it comes into contact with the ground and thereby sustain the forward motion of the bike in a seamless manner, the blunt stabilizing pieces of the Skateez product will not be able to sustain the prior motion of the skater. The contact with the ice of the stabilizing piece that is a few inches in length and has a blunt edge may create substantial friction that will impede the flow of the gliding of the skater upon the ice. The long blunt stabilizing piece being driven into the ice could create increased instability and imbalance for the skater. Moreover, as the Skateez product is focused upon medial and lateral forces it cannot prevent forward and backward instability, or any imbalances or falls caused by such instability. Furthermore, the Skateez product is bulky when fitted upon a skate boot and encumbers a skater so that the skater is impeded from performing skating skills.

U.S. Pat. No. 5,570,893 granted to Orebroskenan Aktiebolag on Nov. 5, 1996, discloses an ice-skate blade that incorporates a central runner and at least one side-runner on each side of the main runner. The main runner further incorporates a discontinuous glide surface one part of which near the center of the blade does not make contact with the ice when the blade is in use. This blade is designed to improve gliding and maneuvering properties when used for skating. However, the configuration of the side-runners incorporate pics extending at a right angle from either side of the main runner. These pics will catch in and gouge into the ice surface if a skater is unbalanced on the blade and may cause the skater to fall. Moreover, as the whole of the main runner is not in contact with the surface of the ice the skater is not balancing on a continuous blade that is in continuous contact with an ice surface, but rather on a front and back section of a blade that are in contact with the ice surface. This configuration can create instability for a skater because it can be difficult for the skater to balance on a non-continuous blade.

Great Britain Patent Application No. 2473205 filed in the name of David Phillips Owens on Mar. 9, 2009, discloses an ice-skate blade that incorporates a curved front leading edge with a curved inwards facing single downward pointed pic, and a curved back leading edge with a curved inwards facing single downward pointed pic. The ice-skate blade is said to allow for free forward and backward sliding action across a horizontal ice surface. The pics are fashioned to engage a horizontal ice surface if the blade is angled away from a horizontal ice surface and slid against the pic point causing that pointed pic to gouge and otherwise be driven deep into the ice surface to resist any such sliding action. Notably, the activity of the pic gouging and being driven into the ice surface to resist sliding action creates a likelihood that the skater will be thrown off-balance, and may even be caused to fall onto the ice surface.

U.S. Pat. No. 94,336 granted to P. A. Peer on Aug. 31, 1869, discloses an ice-skate runner having a round point at both toe and heel, the points are follow or bored out. The hollow points are intended to engage with the ice at any angle and to act as a pivot on which the skater may whirl. Essentially the hollow points are operable in a similar manner to the pics that extend outwards from the surface of some skate blades to allow for gripping of the ice surface so that the skater can achieve spins and jumps. This prior art would create similar issues for the stability of a skater as other prior art that incorporates pics that extend outwardly from the blade in that the hollow points engaging with the ice may imbalance a skater, in particular a beginning or junior skater may be experience imbalance.

German Patent No. 45137 granted to Eugen Wagner on Jan. 21, 1888 discloses an ice-skate blade with inwards facing downward pointed pics near the front edge and back edge of a skate blade. The pointed pies are shaped to engage with the ice surface when the skater skates upon the front or the back edge of the blade. The pointed pics are operable in the same manner as the pics that extend outwards from the surface of some skate blades to allow for gouging and being driven deep into the ice surface so that the skater can achieve spins and jumps. Notably, the activity of the pic gouging and being driven into the ice surface to resist sliding action creates a likelihood that the skater will be thrown off-balance, and may even be caused to fall onto the ice surface.

German Patent Application Publication No. 29708382 in the name of Klaus-Dieter Pollex dated Sep. 4, 1997, discloses an ice-skate blade with inwards facing downward pointed pics near the front edge and back edge of a skate blade. The pointed pies are shaped to engage with the ice surface when the skater skates upon the front or the back edge of the blade. The pointed pics are operable in the same manner as the pics that extend outwards from the surface of some skate blades to allow for gripping of the ice surface so that the skater can achieve spins and jumps, such as are worn by figure skaters. The skate blade further is shaped as rounded on the longitudinal edge of the blade so that two far edges of the blade are in contact with ice surface, but the middle section is rounded away from the ice so that it is not in contact with the ice. This configuration causes a skater to be balanced on one or both of the outer edges of the rounded section of the blade, as one or more both of these edges will be in contact with the ice. The skater cannot balance on the whole surface of the lower edge of a blade when skating because the whole of the lower edge of the blade cannot be in contact with the ice surface due to the rounded shape of the lower edge of the blade. This prior art is not operable to assist a skater to either regain balance or maintain balance upon the blade.

U.S. Patent Application Publication No. 2012/0292886 in the name of Ulf Morgan Friberg published on Nov. 22, 2012, discloses edges for skates that incorporate more than one edge into the skate to allow for an increased grip when turning and braking. Notably, this invention is also disclosed for use with skis and snowboards. This invention is not directed to a skater achieving balance upon a skate blade.

Chinese Patent Application Publication No. 201441804 in the name of Junxiao Ai dated Apr. 28, 2010, discloses an ice-skate blade that has an anti-falling accessory arranged at the rear bottom of the blade. The anti-falling accessory is connected to the skate blade by a screw and once so connected extends from the rear of the blade to be positioned behind the back of the blade. When a user falls backwards the front end of the anti-falling accessory will warp upwards, and when the front end warps at a slight angle, a slip preventing block of the anti-falling accessory touches the ice surface and prevents the front end from warping further upwards. The anti-falling accessory further reduces skating speed so that the skater can regain his or her balance and will be impeded from falling backwards. This prior art does not prevent a skater from falling forwards or prevent a skater from falling due to sliding off either side of the blade.

None of the prior art ice-skate blades have produced a skate blade that is effective in balancing a skater upon the blade, assisting a skater to regain balance upon a blade, and that also may be utilized by a skater to learn and develop basic skating skills. The ability of a skater to balance upon an ice-skate blade is critical for a skater to initially learn to skate, and for a skater to learn and develop skating skills. Thus, the prior art leaves a gap in the art of ice-skate blades in that there is a need for an ice-skate blade that facilitates the balance of a skater upon a skate blade, assists a skater to regain balance upon a skate blade, and that allows a skater to learn and develop skating skills.

SUMMARY OF THE INVENTION

In one aspect, the present disclosure relates to an ice-skate blade for use by a skater to skate upon an ice surface, said ice-skate blade comprising: a front indentation portion positioned in a front section of the skate blade and incorporating one or more grooves cut into the interior of the ice-skate blade, said front indentation portion being operable to engage with the ice surface when the front indentation portion or any portion thereof contacts the ice surface; and a rear indentation portion positioned in a rear section of the skate blade and incorporating one or more grooves cut into the interior of the ice-skate blade, said rear indentation portion being operable to engage with the ice surface when the rear indentation portion or any portion thereof contacts the ice surface; whereby the skater can regain balance upon the ice-skate blade when the skater becomes unbalanced upon the ice-skate blade and the skater can perform basic ice skating skills upon the ice-skate blade.

In another aspect, the present disclosure relates to the ice-skate blade wherein one or more of the one or more grooves in the front indentation portion is operable to engage with the ice surface upon one or more of the following: the skater leans forward on the skate blade and becomes unbalanced upon the skate blade; the skater leans backward on the skate blade and becomes unbalanced upon the skate blade; and the skate blade slips from beneath the skater in any direction and the skater becomes unbalanced upon the skate blade.

In another aspect, the present disclosure relates to the ice-skate blade wherein one or more of the following: the front indentation portion is voluntarily engageable with the ice surface by the skater; and the rear indentation portion is voluntarily engageable with the ice surface by the skater.

In another aspect, the present disclosure relates to the ice-skate blade wherein one or more of the following: the one or more grooves of the front indentation portion are equal in size, shape, angle and depth; the one or more grooves of the rear indentation portion are equal in size, shape, angle and depth.

In another aspect, the present disclosure relates to the ice-skate blade wherein one or more of the following: the one or more grooves of the front indentation portion are of an inconsistent size, shape, angle and depth; and the one or more grooves of the rear indentation portion are of an inconsistent size, shape, angle and depth.

In another aspect, the present disclosure relates to the ice-skate blade wherein the front indentation portion incorporates 8-12 grooves.

In another aspect, the present disclosure relates to the ice-skate blade wherein the rear indentation portion incorporates 8-12 grooves.

In another aspect, the present disclosure relates to the ice-skate blade wherein one or more of the following: the front indentation portion is positioned in accordance with the curvature of the front section of the blade; and the rear indentation portion is positioned in accordance with the curvature of the rear section of the blade.

In another aspect, the present disclosure relates to the ice-skate blade wherein the front indentation section is positioned in the skate blade so as to be disengaged from the ice surface while the skater is balanced on the skate blade, whereby the skater can perform basic skating skills upon the skate blade.

In another aspect, the present disclosure relates to the ice-skate blade wherein the rear indentation section is positioned in the skate blade so as to be disengaged from the ice surface while the skater is balanced on the skate blade, whereby the skater can perform basic skating skills upon the skate blade.

In another aspect, the present disclosure relates to the ice-skate blade wherein the ice-skate blade is attachable to a variety of skate boots, including one or more of the following: lace-up skate boots, velcro-closure skate boots, leather skate boots, plastic molded skate boots, buckle-closure skate boots, hockey skate boots, figure skating boots, adult-sized skate boots and child-sized skate boots.

In another aspect, the present disclosure relates to the ice-skate blade wherein the skate boot incorporates a skate blade attachment element extending from the lower end of the skate boot and the skate blade is attached to the skate blade attachment element and thereby attached to the skate boot.

In another aspect, the present disclosure relates to the ice-skate blade wherein the ice-skate blade incorporates one or more attachment elements in the upper edge of the skate blade, whereby the ice-skate blade is attachable to a skate boot.

In another aspect, the present disclosure relates to the ice-skate blade wherein two forces are created when at least one of the one or more grooves engages with the ice surface that are: an ice surface force being force upon the ice surface; and a skater force being force upon the skater that moves the skater in a direction required for realignment of the skater's center of gravity whereby a skater regains balance upon the skate blade.

In yet another aspect, the present disclosure relates to an ice-skate blade for use by a skater to skate upon an ice surface, said ice-skate blade comprising one of the following: a front indentation portion positioned in the front section of the skate blade and incorporating one or more grooves cut into the interior of the ice-skate blade, said front indentation portion being operable to engage with the ice surface when the front indentation portion or any portion thereof contacts the ice surface, whereby the skater can regain balance upon the ice-skate blade when the skater becomes unbalanced upon the ice-skate blade; or a rear indentation portion positioned in the rear section of the skate blade and incorporating one or more grooves cut into the interior of the ice-skate blade, said rear indentation portion being operable to engage with the ice surface when the rear indentation portion or any portion thereof contacts the ice surface, whereby the skater can regain balance upon the ice-skate blade when the skater becomes unbalanced upon the ice-skate blade.

In still another aspect, the present disclosure relates to a method of regaining balance upon an ice-skate blade by a skater skating upon an ice surface, said method comprising the steps of: the skater skating upon the ice-skate blade that incorporates one or more of the following: a front indentation portion positioned in the front section of the skate blade and incorporating one or more grooves cut into the interior of the ice-skate blade or the ice-skate blade slipping; and a rear indentation portion positioned in the rear section of the skate blade and incorporating one or more grooves cut into the interior of the ice-skate blade or the ice-skate blade slipping; engaging the front indentation portion with the ice surface when the front indentation portion or any portion thereof contacts the ice surface when the skater becomes unbalanced due to leaning forward upon the ice-skate blade; engaging the rear indentation portion with the ice surface when the rear indentation portion or any portion thereof contacts the ice surface when the skater becomes unbalanced due to leaning backward upon the ice-skate blade; the skater regaining balance upon the ice-skate blade following one of the following: the front indentation portion engaging with the ice surface; or the rear indentation portion engaging with the ice surface; and the skater performing skating skills upon the skate blade when the skater is balanced upon the ice-skate blade.

In another aspect, the present disclosure relates to the method of regaining balance upon an ice-skate blade comprising the further step of the skater engaging the front indentation portion with the ice surface voluntarily by leaning forward on the ice-skate blade.

In another aspect, the present disclosure relates to the method of regaining balance upon an ice-skate blade comprising the further step of the skater engaging the rear indentation portion with the ice surface voluntarily by leaning backward on the ice-skate blade.

In another aspect, the present disclosure relates to the method of regaining balance upon an ice-skate blade of claim 15, said method comprising the further step of interrupting a skater's momentum and redirecting the skater to the direction required for the skater to regain balance upon the ice-skate blade upon one of the following: the engaging of at least a portion of the rear indentation portion with the ice surface; and the engaging of at least a portion of the front indentation portion with the ice surface.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

The invention will be better understood and objects of the invention will become apparent when consideration is given to the following detailed description thereof. Such description makes reference to the annexed drawings wherein:

FIG. 2 is a side view of a front portion of the ice-skate blade that is an embodiment of the present invention having multiple indentations in the outer section of the blade.

FIG. 3 is a front view of a front portion of the ice-skate blade that is an embodiment of the present invention having multiple indentations in the outer section of the blade.

FIG. 4 is a bottom view of a front portion of the ice-skate blade that is an embodiment of the present invention having multiple indentations in the outer section of the blade.

Figure 1:
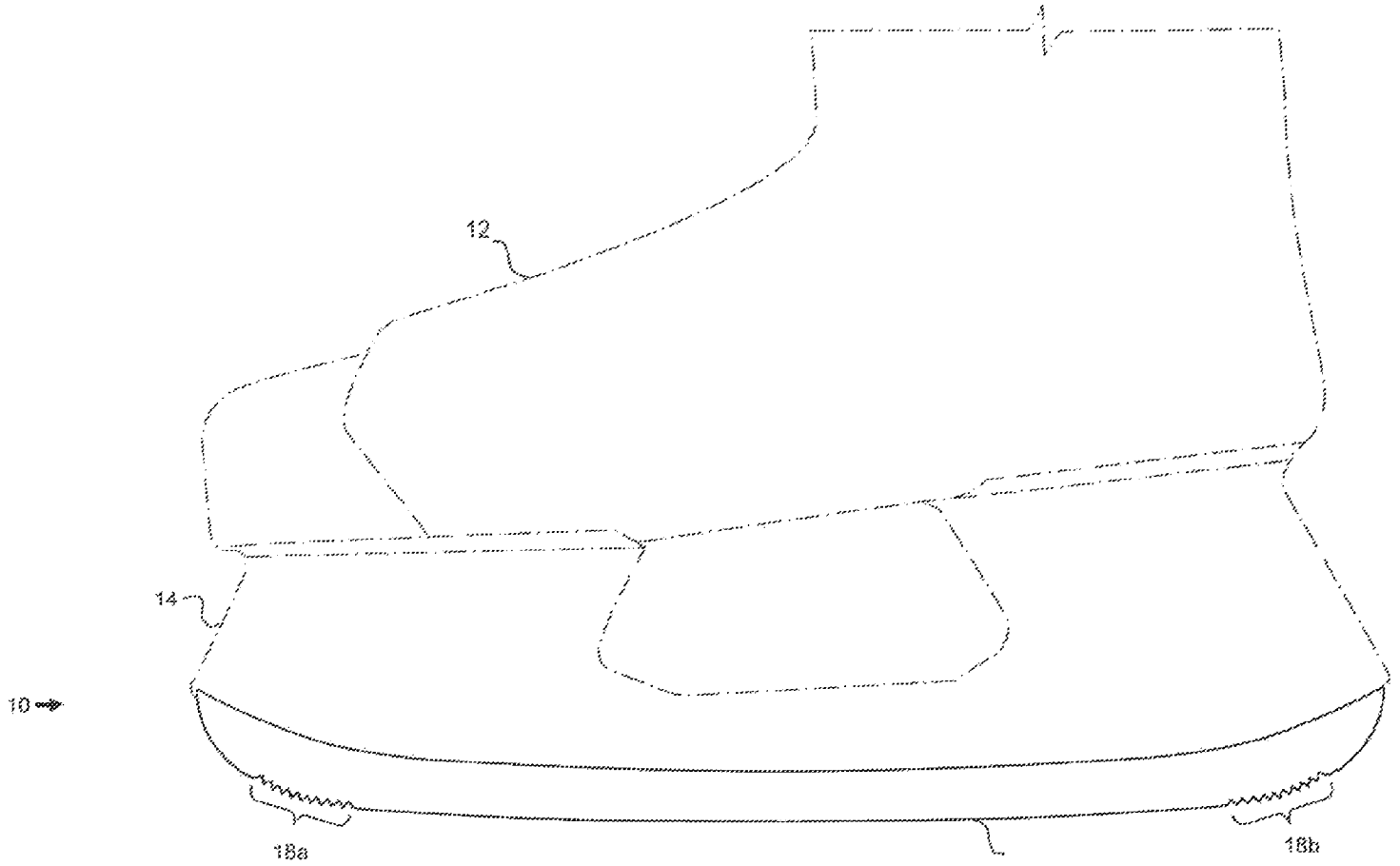
FIG. 1 is a side view of an ice-skate blade that is an embodiment of the present invention, and further shows how the blade may be attached to a skate boot via a skate blade holder extending from the lower section of the skate boot.

In the drawings, embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENT

The present invention is an ice-skate blade formed to increase the balance of a skater upon an ice-skate blade. The blade may incorporate indentations in one or more both of the following position: a portion of the front section of the skate blade; and a portion of the rear section of the skate blade. Such indentations may be a series of serrated cuts or otherwise formed notches in the lower blade edge. The blade may be formed in a variety of sizes, and may be connectable to a variety of skate boots. A skater utilizing the blade of the present invention will be assisted with regaining balance upon the blade upon experiencing unbalance, and assisted with maintaining balance upon the skate blade. The blade functions in a manner that allows a skater to learn and develop skating skills.

The words "ice-skating blade", "skating blade", "ice-skate blade", "skate blade" and "blade" as well as plural forms of these words may be utilized interchangeably herein to mean ice-skate blade.

The present invention is a skate blade that can be utilized by a beginner skater, a skater learning skating skills, as well as a skater who has experience and wishes to perform skating skills. The present invention incorporates indentations in portions of the front and/or rear sections of the blade. These indentations can assist a skater who becomes imbalanced upon the blade to regain his or her balance upon the blade. The indentations are positioned in the skate blade such that the performance of skating skills by the skater is not impeded by the indentations. One or more indentations may be incorporated in indentation portions of the blade.

An absolute novice who has never skated before can utilize the skates to learn to balance upon the skate blades, which is necessary to learn and perform any skating skills. The same skater can still utilize the skate blades as the skater starts to learn skating skills as the indentations will assist the skater to regain balance should the skater become imbalanced upon the skate blades while the skater is learning skating skills. Moreover, as the indentations do not impede a skater from performing skating skills, the skater can continue to utilize the skate blades of the present invention once the skater is performing skating skills without any tendency to become imbalanced upon the skate blades.

The present invention can be utilized by skaters of a variety of skating levels.

The present invention is operable so that when a skater's center of balance is shifted too far to the front or to the rear of the blade indentations in the blade will engage with the ice to disrupt the either forward or backwards momentum. The indentations in the blade will also engage with the ice and disrupt the momentum of the skater towards further imbalance if the blade slips under the skater in any direction, including in any sideways direction.

Upon the disruption of the skater's momentum the skater will be caused to move in the direction necessary for the skater to regain balance upon the blade. For example, if the skater is leaning too far forward the front indentation section of the blade will engage with the ice surface and the skater's momentum forward will be interrupted and force will be exerted on the body of the skater that will force the skater's body in a direction that will assist the skater to regain balance upon the blade. The strength of the force exerted upon the skater's body will depend upon several factors, including the speed of the momentum of the skater, and the portion of the indentation portion of the blade that engages with the ice surface (e.g., the larger the portion of the indentation portion that engages with the ice surface the greater the force exerted upon the skater).

The interruption of the momentum of the skater may be such that the skater is not stopped from gliding upon the ice. The skater may continue gliding upon the ice in the same direction as prior to the interruption while regaining balance upon the skate blade. The interruption of the momentum of the skater may not be abrupt or jarring to the skater in some instances, while it may be abrupt and jarring to the skater in other instances. The abruptness or jarring effect or nature of the interruption of the momentum upon the skater will depend upon several factors, including the speed of the momentum of the skater prior to the interruption, and the portion of the indentation portion of the blade that engages with the ice surface (e.g., the larger the portion of the indentation portion that engages with the ice surface the greater the force).

For example, if a lesser portion of an indentation portion of the blade engages with the ice surface the result will be that a lesser pulling effect is exerted on the skate blade. A lesser portion of the indentation portion will engage with the ice surface when the skater loses balance when moving with low speed and momentum. In such an instance the force exerted upon the skater's body by the gripping of the portion of the indentation portion of the blade with the ice will be weak, and in some instances minimal, and therefore the realignment of the skater's balance will be less abrupt for the skater.

As another example, if a greater portion of an indentation portion of the blade engages with the ice surface the result will be that a greater pulling effect is exerted on the skate blade. A greater portion of the indentation portion will engage with the ice surface when the skater loses balance when moving at a fast speed and momentum. In such an instance the force exerted upon the skater's body by the gripping of the portion of the indentation portion of the blade with the ice will be strong, and therefore the realignment of the skater's balance may be abrupt and in some instances may be jarring for the skater.

Thus, when an imbalance of the skater causes a portion of the indentation portion of the blade to engage with the ice surface, the force exerted upon the skater to counteract the imbalance may vary from subtle to abrupt, in accordance with several factors. The two forces will result in each instance of imbalance. In some instances such forces may be equitable. The two forces include the force created by the skater's loss of balance that causes a portion of the indentation portion of the blade to grip the ice surface, and the force upon the skater that moves the skater in the direction required for realignment of the skater's center of gravity and regaining balance upon the skate blade. The skater's balance may be realigned to the point equal to before the skater first started to experience a loss of balance upon the blade.

For example, if a skater becomes imbalanced upon a blade due to the skater leaning too far forward, a portion of the front indentation portion of the blade may engage with the ice surface. The force upon the skater may move the skater backward from the position the skater was in when one or more of the indentation in the front indentation portion engaged with the ice surface. In this manner the skater is moved by the exertion of force from the forward position that created imbalance to a position that realigns the skater's center of gravity and allows a skater to balance upon the blade.

Once a skater is balanced upon the blade the skater may perform skating skills. In some instances if the forces exerted as described herein were of low strength the skater's gliding upon the blade in a particular direction may have been slowed but not stopped altogether by the imbalance and the forces created as a result thereof.

In the context of the present invention, force is a push or pull that acts upon the body of the skater as the result of the engagement of a portion of, or all of, an indentation portion of the blade with the ice surface. The force of the engagement and gripping of the ice surface will be commensurate with the portion of the indentation portion of the blade that grips or engages with the ice surface. The larger the portion of the indentation portion that grip or engages with the ice surface the greater the force: (i) on the ice surface created by the engagement of the portion of the indentation portion with the ice surface; and (ii) upon the skater. The gripping of a portion of the indentation portion of the blade with the ice surface creates a pulling effect on the skate blade.

As the indentations in the blade are shaped so that they are formed into the blade, and do not extend outwardly from the edge of the blade, the engagement of the indentations in the blade with the ice will not cause any portion of the blade to gouge or be driven deep into the ice. The contact of the indentations in the blade with the ice may slow the skater's momentum and allow for an opportunity to counteract, realign and stabilize the skater's center of gravity. The skater will thereby become once again balanced upon the blade.

As the body has a tendency to preserve a state of uniform motion unless acted upon by an external force, once a skate blade starts to slip out from under a skater this slipping motion will continue until it is counteracted. The present invention activates a means of interrupting the momentum of a slipping skate blade by the indentations in the blade engaging with the ice when the blade begins to slip. As the engagement of the ice with the indentations in the blade is not caused by any portion of the blade gouging and being driven deep into the ice, the interruption of the momentum may be abrupt for the skater, but it will ultimately cause the skater to move his or her body in the direction required to realign the skater and allow the skater to be rebalanced upon the blade. The skater can therefore regain his or her balance upon the skate blade without falling.

The present invention functions to create and maintain stability and balance for a skater skating upon the ice-skating blades of the present invention. The skate blade of the present invention does not encumber the use of the skate blades to perform basic skating skills. For example, the present invention does not interfere with a skater performing any skating skills such as standing upon the blades, the skater's natural skating stride or glide, or the ability of the skater to change direction. Therefore, the present invention can be utilized by skaters with a range of skating abilities, including skaters who are first learning to skate, beginner skaters, junior skaters, and more experienced skaters.

Notably, skate blades that have pies or other sections formed therein that extend outwardly from the edge of the skate blade, or that are formed to engage with the ice surface so as to gouge and be driven deep into the ice surface, are generally configured for the purpose of a skater engaging in jumping or spinning. Outwardly extending pics or other portions of a skate blade formed to gouge or otherwise be driven deep into the ice surface can be tripping and falling hazards to a skater. Skate blades with outwardly extending pics or other portions formed to gouge and be driven deep into an ice surface are difficult for beginning and junior skaters to utilize to learn and develop basic skating skills. The present invention does not incorporate any outwardly extending pic or section formed to gouge or be driven deep into the ice surface, and thereby does not pose the tripping and falling hazards of such the prior art skates.

As establishing and maintaining balance is critical to building and developing skating skills, the present invention by assisting a skater to learn to balance upon skate blades facilitates learning and development of skating skills. For example, the present invention creates stability and balance upon skate blades that assists a skater to standup on their skate blade, to stand on the spot on their skate blades, to push off on their skate blade, and to stop on their skate blades, as well as to perform other skating skills.

The skate blade of the present invention is attachable to a variety of types of skate boots, including off-the-shelf skate boots. Embodiment of the present invention may be attached to lace-up skate boots, velcro-closure skate boots, leather skate boots, plastic molded skate boots, buckle-closure skate boots, hockey skate boots, figure skating boots, adult-sized skate boots and child-sized skate boots.

The length, width and height of the skate blade of embodiments of the present invention may vary in accordance with the size and type of the skate boot that the skate blade is to be attached to. Additionally, the skate blade may have additional elements incorporated in the top edge of the skate blade, such as elements required for connection to a type of skate boot.

For example, a skate blade that is attached to a hockey skate may be incorporated directly into an attachment means extending for the skate boot, as shown in FIG. 1.

As another example, a figure skate boot, or other types of skate boots, may require that one or more extension elements be incorporated into the upper edge of the skate blade (e.g., the edge of the skate blade direction opposite the lower edge of the skate blade) and attachment elements required to attach the skate blade to the figure skate boot may further be incorporated in such extension elements. A skilled reader will recognize the types of extension elements and attachment elements that may be incorporated in the skate blade of embodiments of the present invention.

The present invention offers several advantages and benefits over prior art skate blades. The indentations in the blade of the present invention do not gouge into the ice or otherwise create friction with the ice surface as is created by prior art skates that incorporate outwardly formed pics, or other portions of the blade that are formed in prior art skates to be driven deep into the ice, or elements in a skate blade that are meant to come into contact with the ice surface and act in the same manner as pics. The present invention does not create imbalance for the skater due to an element of the blade gouging into the ice or otherwise being driven deep into the ice surface, as prior art blades can do. The present invention thereby does not create a likelihood that a skater will be thrown off balance or fall due to an element gouging the ice or being driven deep into the ice which is a likelihood created by prior art skate blades. The engagement of a portion or all of an indentation portion of the blade of the present invention with an ice surface has the effect of correcting an imbalance of a skater, it does not create increase the imbalance of the skater, as occurs with other prior art blades.

The present invention has a further advantage and benefit over the prior art in that the present invention can assist a skater to correct an imbalance upon the blade in any direction. The present invention can assist with correcting an imbalance in a forward, backward, or any other direction that at skate blade may slip. The prior art generally only corrects imbalance in one or two directions.

The present invention offers another advantage and benefit over the prior art in that it does not create an encumbrance to the skating experience of the skater or the use of the skate blades to perform basic skating skills. Prior art skate blades, or accessories that are connected to skate blades, do not permit a skater to utilize his or her skate blades to perform basic skating skills. Prior art skate blades disclosed to be formed to assist a skater with learning to skate generally do not allow the skate blade to function to perform basic skating skills when a skater is balanced on the blades. Prior art skate blades tend to have added pieces that encumber a skater from performing skating skills, or are formed so that portions of the skate blade are not in contact with the ice as required for the performance of some skating skills. The present invention allows a skater to learn to balance upon his or her skate blades, and to also learn skating skills, while prior art skate blades do not allow a skater to both to regain balance and to learn skating skills. Thus, the present invention can be utilized for more than merely beginner skaters learning to achieve and maintain balance on the ice and therefore has a longer and wider scope of purpose for skaters of varying skill levels than prior art skate blades.

The wider purpose of the present invention evidences another advantage and benefit of the present invention over the prior art, in that the present invention is more cost effective than prior art skates. The present invention has a wider scope of use by a skater, in that the skater can learn to skate upon the skate blades of the present invention and can develop skating skills upon the skate blades of the present invention. Prior art skate blades do not permit both of these functions. Thus, the present invention skate blades are likely to be used longer by skaters as they progress through a variety of skill levels, and this will likely save the skater money as he or she will not have to buy a new pair of skates once he or she learns to skate and to maintain balance on the blades of the present invention.

The present invention offers further cost benefits and advantages over the prior art skate blades in that the present invention skate blades can be incorporated with a variety of skate boots, including off-the-shelf skate boots. Thus, the present invention offers another cost-advantage to a skater over the prior art skate blades.

The present invention skate blade additionally offers the advantage and benefit over double bladed beginner skates, in that the skaters utilizing the present invention can attain skating skills upon a blade that has the same feel as a traditional advanced skate blades. A skater who learns upon double skate blades integrated into each skate, such as bob skates, has to undergo another learning process when advancing to traditional advanced skate blades that are single blades upon a single skate. The feel for balancing upon the skate differs if there are two blades in the skate than if there is a single blade in the skate. Thus, the present invention offers the advantage and benefit that it is not simply a beginner blade, even though it is of assistance to beginning skaters. The present invention incorporates a single blade and therefore provides the skater with a similar feel to traditional single blade skates. Therefore, the advancement of a beginning skater who learns upon skates incorporating the skate blade of the present invention will more easily advance to more advanced skating skills and will be able to more comfortably utilize traditional skates than a skater who begins learning upon prior art skates that have two blades incorporated in each skate.

The present invention skate blades further offer several advantages and benefits over the prior art skate blades that relate to the skating experience of the skater. For example, because the present invention skate blade helps the skater to regain balance upon the skate blade and allows for the performance of skating skills, the novice skater has the ability to move immediately upon arriving on the ice. This creates for the skater an immediate sense of achieving some form of skating proficiency, which is not possible utilizing prior art skate blades. A skater utilizing the skate blades of the present invention builds confidence as he or she discovers the ability to skate while regaining balance upon an imbalance and avoiding falls. This assists the skater to quickly develop basic skating skills because the skater feels a sense of self-assurance and stability upon his or her skates. The skater thereby is likely to move on to more advanced skating skills sooner than skaters utilizing prior art skate blades. The skater utilizing the skate blades of the present invention has an increased chance of participating in skating in the future beyond a first attempt, as fear of falling is reduced and desire and confidence to develop skating skills is consequently increased beyond what is achievable upon prior art skate blades.

Examples of embodiments of the present invention are shown in the drawings. A skilled reader will recognize that various embodiments of the present invention that are possible in accordance with the description of the invention herein.

As shown in FIG. 1, the skate blade 10 is attachable to various forms of a skate boot 12, including a skate boot that incorporates a blade attachment element 14. The skate blade 10 is attached to the blade attachment element and thereby attached to the skate boot so that the wearer of the skate boot can skate upon the skate blade. The skate blade incorporates one or more indentations 20 formed in a portion of the lower edge 16 of the blade that is downward facing when a skater skates upon the skate blade. The indentations may be formed in a front indentation portion 18*a* of the blade and a rear indentation portion 18*b* of the blade.

When a skater skates upon the skate blade the lower edge 16 will contact the ice surface. Should the skater's center of gravity shift so that the skater is leaning forward on the skate blade one or more of the indentations in the front indentation portion of the skate blade will contact the ice. As discussed herein, the indentations will not gouge or otherwise be driven deep into the ice. When one or more of the indentations contact the ice surface the momentum of the skater caused by the shift of the skater's center of gravity upon the skater leaning forward on the blade will be interrupted. The forward imbalance of the skater caused by the skater leaning forward on the blade will be counteracted and disrupted. The skater will be able to realign and stabilize his or her center of gravity. The skater's balance on the blade can thereby be restored in the manner discussed herein.

Should the skater's center of gravity shift so that the skater is leaning backwards on the skate blade one or more of the indentations in the rear indentation portion of the skate blade will contact the ice. As discussed herein, the indentations will not gouge or otherwise be driven deep into the ice. When one or more of the indentations contact the ice surface the momentum of the skater caused by the shift of the skater's center of gravity upon the skater leaning back on the blade will be interrupted. The backward imbalance of the skater caused by the skater leaning back on the blade will be counteracted and disrupted. The skater will be able to realign and stabilize his or her center of gravity. The skater's balance on the blade can thereby be restored in the manner discussed herein.

One or more indentations in an indentation portion of the skate blade of the present invention may engage with the ice surface should the blade slip underneath the skater in any direction. A slipping blade will cause a skater to become unbalanced on the blade. As a skilled reader will recognize, any slipping of the blade forwards, backwards, to the side, or in any other direction, will cause at least one of the indentations to engage with the ice. This engagement of at least one of the indentations with the ice surface will create the forces upon the ice surface and upon the skater discussed herein. The skater will thereby be assisted with realigning and stabilizing his or her center of gravity and rebalancing on the blade in the manner described herein.

The indentations in the blade are formed as serrated cuts or other types of notches formed along the lower edge 16 of the blade into the interior of the blade. The blade does not include any pics or other types of points that extend from the outer edge of the lower edge 16 of the blade. The indentations therefore do not gouge into the ice surface when the indentations engage with the ice surface. The indentations are not driven deep into the ice when the indentations engage with the ice surface. The indentations will grip the ice and may dig into the ice in some instances depending on the strength of the force created by the engagement of the ice surface and the at least one indentation. The stronger the force the more likely it is that the at least one indentation may dig into the ice.

The engagement of one or more of the indentations with the ice surface may be abrupt or jarring for the skater depending on the strength of the forces created by the interruption created by the engagement, as discussed herein. Generally a force will cause the skater's body to move in the direction necessary for the skater to regain balance upon the blade. Any jarring or abrupt effect for the skater will not be such that it causes the skater to fall.

The engagement of one or more of the indentations with the ice surface will not necessarily stop the flow of the gliding of the skater if the skater was gliding prior to experiencing an imbalance upon the blades (whether that gliding flow in is the forwards or backwards direction). The engagement of one or more of the indentations with the ice surface may slow the skater's momentum, gliding and flow. As the momentum is slowed the skater can correct his or her position on the skate blades so as to be balanced on the skate blades.

For example, following the interruption in the skater's momentum the skater may be moved in a direction that is the opposite direction from the direction that was causing the imbalance. Generally, the skater is thereby moved away from the direction creating imbalance and towards the direction whereby balance can be regained. The skater will be assisted by such corrective movement to realign and rebalance upon the blade.

The engagement of the skate blade with the ice can be utilized to assist a skater to regain his or her balance as described herein, when a skater is gliding on the ice (either in a forwards or backwards direction), or when a skater is stationary upon the ice. The engagement of the skate blade with the ice, as described herein, can stop the skate blade from slipping, and thereby keep the skater from falling, and allow a skater to regain and maintain balance upon the skate blades while skating or standing.

The engagement of one or more of the indentations of the blade with the ice surface can also be of assistance to a skater who is repositioning himself or herself from a position of sitting or kneeling upon the ice to a position of standing upon the ice. In order to stand up on the ice from a sitting or kneeling position a skater must place weight upon one skate that is positioned upon the ice so that the weight is borne upon the skate blade of that skate. By putting weight on that skate the skater can push himself or herself up into a position of standing upon both feet on the ice. One or more of the indentations in the front indentation portion of the skate blade that will bear the weight of the skater moving to a standing position may initially engage with the ice surface. The engagement of such indentations with the ice surface may assist the skater in gaining stability on the skate blade. The engagement of such indentations with the ice may keep the blade from slipping out from under the skater as the skater is moving from a sitting position to a standing position. Additionally, during the process of moving from a sitting to a standing position, one or more of the indentations in the front indentation portion or the rear indentation portion of the skate blades may engage with the ice in the manner described herein if the skater leans forwards, backwards, sideways or in any other direction on the blades while moving from a sitting to a standing position. This engagement will assist the skater to regain his or her balance on the skate blades and prevent the skater from falling down.

Generally a skater will fall down if the momentum that creates imbalance is allowed to continue unchecked. The engagement of at least one of the indentations of the blade of the present invention upon an imbalance occurring, as described herein, interrupts the momentum of the imbalance. The interruption in the momentum of the imbalance can stop the imbalance from increasing. If the imbalance increases it will lead to the skater falling, so interrupting the imbalance stops the imbalance from increasing and avoids the fall. Additionally, the forces activated by the interruption, as described herein assist the skater with regaining balance on the blade in a manner that moves the skater in a direction away from the direction creating the imbalance, and this further averts a fall.

As shown in FIG. 2, the front indentation portion 18*a* of the blade can incorporate multiple indentations. The indentations can be formed as v-shaped, triangular or any other shape. The indentations are cut into the front lower edge 16*a* of the blade. V-shaped indentations as shown in the drawings can be formed so that each indentation incorporates an angled side 20*b*, and two angled sides of each indentation will meet to form a peak or point 20*a* at the front lower edge 16*a* of the blade. Sides of the two adjacent indentations will further meet away from the front lower edge 16*a* of the blade to form an inverted point 20*c* or other form of depression depending on the shape of the indentations.

In an embodiment of the present invention the front indentation portion may incorporate grooves or serrations that are cut to be 2 millimeters in depth. A skilled reader will recognize that cuts of varying angle, shape, size, width, and/or depth are possible in embodiments of the present invention. Moreover, as shown FIG. 9, the cuts within an indentation portion of the blade do not have to be a uniform size in some embodiments of the present invention.

As shown in FIG. 2, the front indentation portion 18*a* of the blade can incorporate multiple indentations. The indentations can be formed as v-shaped, triangular or other groove forms. The indentations are cut into the front lower edge 16*a* of the blade in a direction towards the upper edge of the blade.

As shown in FIG. 3, one or more of the front indentation portion of the blade may be viewable from a front view of the blade facing the front tip 32 of the blade. As shown in FIG. 4, the front indentation portion of the skate blade is visible from a bottom view of the skate blade.

Figure 5:
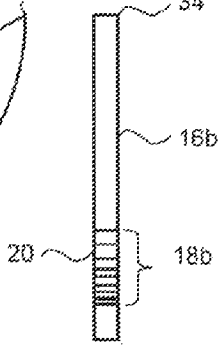
FIG. 5 is a front view of a rear portion of the ice-skate blade that is an embodiment of the present invention having multiple indentations in the outer section of the blade.
Figure 6:
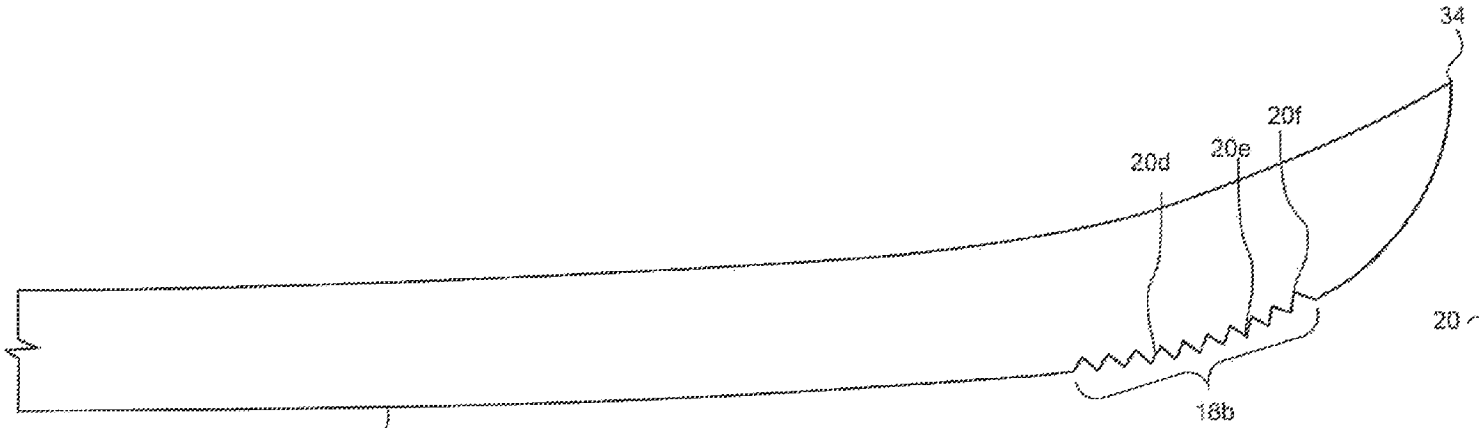
FIG. 6 is a bottom view of a rear portion of the ice-skate blade that is an embodiment of the present invention having multiple indentations in the outer section of the blade.
Figure 7:
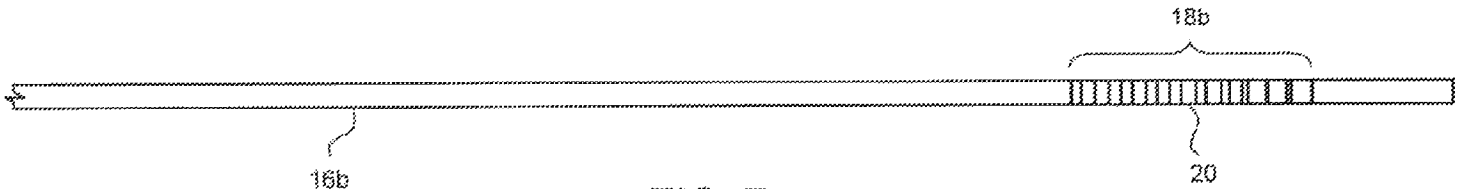
FIG. 7 is a bottom view of a rear portion of the ice-skate blade that is an embodiment of the present invention having multiple indentations in the outer section of the blade.

As shown in FIGS. 5-7 one or more indentations may be incorporated into a rear indentation portion 18*b* of the rear lower edge 16*b* of the skate blade. The rear indentation portion is displaced from the back tip 34 of the blade so that there is space between the back tip and the start of the rear indentation portion of the skate blade.

As shown in FIG. 6, the rear indentation portion 18*b* of the blade can incorporate multiple indentations. The indentations can be formed as v-shaped, triangular or other groove forms. The indentations are cut into the rear lower edge 16*b* of the blade in a direction towards the upper edge of the blade. Each indentation will be formed to incorporate an angled side 20*d*, and two sides will meet to form a peak or point 20*e* at the rear lower edge 16*b* of the blade. Sides of the adjacent indentations will further meet away from the rear lower edge 16*b* of the blade to form an inverted point 20*f* or other form of depression depending on the shape of the indentations.

As shown in FIG. 5, one or more of the rear indentation portion of the blade may be viewable from a front view of the blade facing the rear tip 34 of the blade. As shown in FIG. 7, the rear indentation portion of the skate blade is visible from a bottom view of the skate blade.

Figure 8:
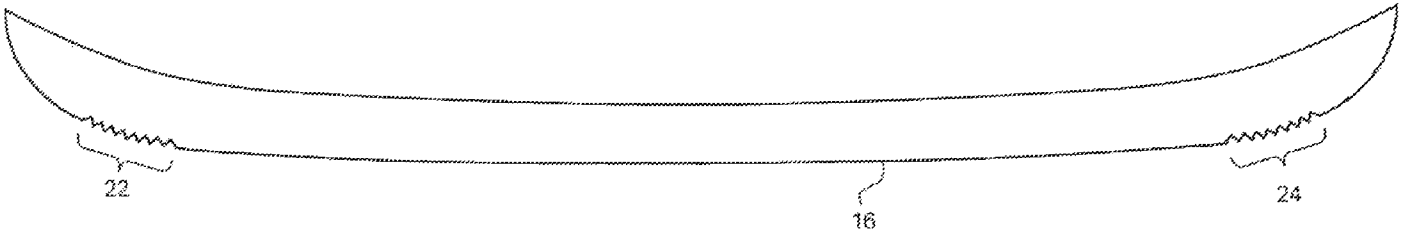
FIG. 8 is a side view of an ice-skate blade that is an embodiment of the present invention, having multiple indentations in a portion of the front section and a portion of the rear section of the blade.
Figure 9:
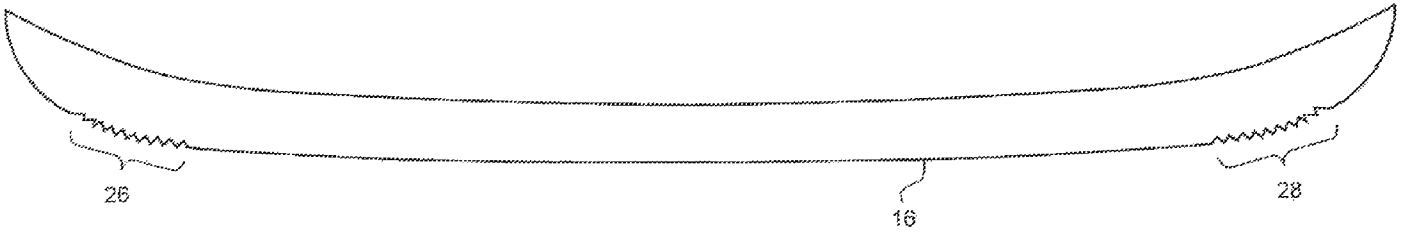
FIG. 9 is a side view of an ice-skate blade that is an embodiment of the present invention, having multiple indentations in a portion of the front section and a portion of the rear section of the blade.

The number of indentations in either the front indentation portion or the rear indentation portion of the skate blades may vary, as shown in FIGS. 8 and 9. There may be a different number of indentations in the front indentation portion than are included in the rear indentation portion in some embodiments of the present invention.

As an example, in one embodiment of the present invention there may be 8-12 grooves cut into each of, or either of, the front indentation portion and the rear indentation portion. As a further example, in one embodiment of the present invention there may be 10 grooves cut into each of, or either of, the front indentation portion and the rear indentation portion. A skilled reader will recognize that other numbers of grooves may be incorporated into each of the front indentation portion and rear indentation portion, as shown in the FIGs. The present invention requires at least one indentation, and requires at least one of a front indentation portion or a rear indentation portion. A skilled reader will further recognize that the number of grooves incorporated in a front indentation portion may differ from the number of grooves incorporated in a rear indentation portion of a single blade.

In one embodiment of the present invention the grooves incorporated in the front indentation portion and/or the rear indentation portion of a blade may be cut at a 20' groove angle from the curvature of the blade. A skilled reader will recognize that in embodiments of the present invention the indentations cut into the front indentation portion 26 and/or the rear indentation portion 28 may vary in size, angle, shape, as shown in FIG. 9. In other embodiments of the present invention the indentations cut into the front indentation portion 22 and/or the rear indentation portion 24 may be uniform in size, angle and shape as shown in FIG. 8. In embodiments of the present invention the size, angle, shape, depth, etc. of indentations may vary within the front indentation portion and be uniform in the rear indentation portion. In other embodiments of the present invention the size and shape of indentations may vary within the rear indentation portion and be uniform in the front indentation portion. In still other embodiments of the present invention there may only be a rear indentation portion or a front indentation portion incorporated in a single blade.

A skilled reader will recognize that there is a wide range of variations of the number of indentations and the size, shape, etc. of indentations that may be included in any of the front indentation portion and/or the rear indentation portion. Variations of the number of indentations and the size and shape indentations may offer different levels of stability and ease of correcting any imbalance on the skate blades, as well as for maintaining balance on the skate blades. Some variations of number and/or size, shape, etc. of the indentations may have benefits for adults, for children, for females, for males, and for person of different weights, height or foot sizes. Thus, it may be possible that blades of varying numbers and/or shapes, sizes, etc. of indentations may be incorporated into embodiments of the present invention configured for variant skaters and variant skater groups.

Figure 10:
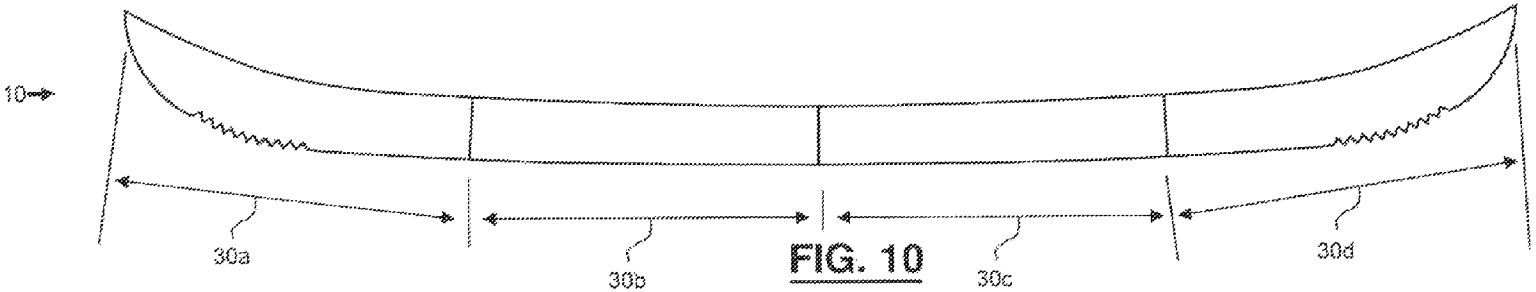
FIG. 10 is a side view of an ice-skate blade that is an embodiment of the present invention, showing the relative quarter sections of the blade, so that a front section, a middle front section, a middle rear section and a rear section of the blade are shown, and multiple indentations are formed in a portion of the front section and a portion of the rear section of the blade.

The positioning of the front indentation portion and the rear indentation portion in embodiments of the present invention may be in accordance with the proportions of sections of the skate blade. As shown in FIG. 10, in one embodiment of the present invention the skate blade 10 may be portioned into four sections, a front blade section 30*a*, a front middle blade section 30*b*, a rear middle blade section 30*c*, and a rear blade section 30*d*. These blade sections may each be of equal size in some embodiments of the present invention or may be of different sizes in other embodiments of the present invention.

The front indentation portion of the skate blade may be positioned within the front blade section and the rear indentation portion of the skate blade may be positioned with the rear blade section. The positioning may be so as to position the front indentation portion in the middle of the front blade section in some embodiments of the present invention. The positioning may be so as to position the rear indentation portion in the middle of the rear blade section in some embodiments of the present invention.

In embodiments of the present invention, the front indentation portion and/or the rear indentation portion may be positioned to represent a specific proportion of the overall blade. For example, in one embodiment of the present invention the blade from front to rear may have the following proportions: 10% of the blade extends from the front tip to the front-most edge of the front indentation portion; 20% of the blade is comprised of the front indentation portion; 40% of the blade extends from the rear-most edge of the front indentation portion and the front-most edge of the rear indentation portion; 20% of the blade is comprised of the rear indentation portion; and 10% of the of the blade extends from the rear-most edge of the rear indentation portion to the rear tip. A skilled reader will recognize that these proportions are provided only as examples and that other proportions of the blade are possible in embodiments of the present invention.

In embodiments of the present invention, the front indentation portion and rear indentation portion may be positioned on the blade in relation to the curvature of the blade. The blade curves at the front of the blade towards the front tip and at the rear of the blade towards the rear tip. When the blade is in use a portion of the blade is in contact with the ice, while the curved portions at the front and rear of the blade are not in contact with the ice unless the skater leans forward or backward on the skate blade, or the skate blade slips beneath the skater. If a skater leans forward on the blade a portion of, or all of, the font curved section may come into contact with the ice surface. Whereas, if a skater leans backward on the blade a portion of, or all of, the rear curved section may come into contact with the ice surface. A portion of, or all of the curved sections of the blade may come into contact with the ice surface if the blade slips from under the skater in any direction.

The front indentation portion may be positioned in relation to the front curved section of the blade so that none of the front indentation portion will be in contact with the ice when a skater is balanced upon the blade. The front indentation portion may be positioned in the blade so that when a skater leans forwards at least a portion of the front indentation section will come into contact with the ice surface. In this manner the front indentation section will be positioned in a portion of the front curvature of the blade, as shown in FIG. 2.

In embodiments of the present invention none of the front indentation portion will be in contact with the ice surface when a skater is balanced upon the blade. Thus, the skater will not experience any of the effect of the front indentation portion engaging with the ice while the skater is balanced upon the blade, and the skater may perform skating skills without experiencing any effect of the front indentation portion engaging with the ice as long as the skater remains balanced upon the blade.

The effect of the front indentation portion engaging with the ice will differ in accordance with the amount of the front indentation portion that engages with the ice, as well as other factors, such as the speed of the skater prior to the front indentation portion engaging with the ice surface. For example, the farther forward that a skater leans on the blade the more of the front indentation portion that will engage with the ice, and the more of the front indentation portion engages with the ice the skater will feel a greater effect of such engagement. The greater the effect of the engagement the more forcefully the skater's body will be forced in a direction that counteracts any imbalance to allow the skater to correct the imbalance and to regain balance upon the blades. The front indentation portion does not extend outwards from the edge of the blade and therefore will not gouge and become driven deep into the ice which can increase the likelihood of falling for a skater. Instead the present invention not only interrupts a skater's momentum towards falling, but causes the skater's body to move in a direction that assists the skater with regaining balance upon the blade.

The front indentation portion will create some friction with the ice surface as each peak or point engages with the ice. Thus, the smooth gliding motion that occurs when a flat or relatively flat section of the blade that is free from any indentations is in contact with the ice will be replaced with intermittent contact of the blade with the ice when the indentations contact the ice. When any portion of the front indentation portion engages with the ice the skater's gliding momentum is slowed down from the speed of the previous gliding momentum.

The engagement of the ice and the peaks or points of the front indentation portion will create some friction with the ice. The momentum of the skater will be slowed and the skater will be able to regain his or her balance upon the blade. The slowing of momentum will occur as each intermittent peak or point in the front indentation portion engages with the ice. The more peaks or points in the front indentation portion that engages with the ice the greater the slowing of the skater's momentum.

The rear indentation portion may be positioned in relation to the rear curved section of the blade so that none of the rear indentation portion will be in contact with the ice when a skater is balanced upon the blade. The rear indentation portion may be positioned in the blade so that when a skater leans backwards at least a portion of the rear indentation section will come into contact with the ice surface. In this manner the rear indentation section will be positioned in a portion of the rear curvature of the blade, as shown in FIG. 2.

In embodiments of the present invention none of the rear indentation portion will be in contact with the ice surface when a skater is balanced upon the blade. Thus, the skater will not experience any of the effect of the rear indentation portion engaging with the ice while the skater is balanced upon the blade, and the skater may perform skating skills without experiencing any effect of the rear indentation portion engaging with the ice as long as the skater remains balanced upon the blade.

The effect of the rear indentation portion engaging with the ice will differ in accordance with the amount of the rear indentation portion that engages with the ice, as well as other factors, such as the speed of the skater prior to the rear indentation portion engaging with the ice surface. For example, the farther backward that a skater leans on the blade the more of the rear indentation portion that will engage with the ice, and the more of the rear indentation portion engages with the ice the skater will feel a greater effect of such engagement. The greater the effect of the engagement the more forcefully the skater's body will be forced in a direction that counteracts any imbalance to allow the skater to correct the imbalance and to regain balance upon the blades. The rear indentation portion does not extend outwards from the edge of the blade and therefore will not gouge and become driven deep into the ice which can increase the likelihood of falling for a skater. Instead the present invention not only interrupts a skater's momentum towards falling, but causes the skater's body to move in a direction that assists the skater with regaining balance upon the blade.

The rear indentation portion will create some friction with the ice surface as each peak or point engages with the ice. Thus, the smooth gliding motion that occurs when a flat or relatively flat section of the blade that is free from any indentations is in contact with the ice will be replaced with an intermittent contact of the blade with the ice when the indentations contact the ice. When any portion of the rear indentation portion engages with the ice the skater's gliding momentum is slowed down from the speed of the previous gliding momentum.

The engagement of the ice and the peaks or points of the rear indentation portion will create some friction with the ice. The momentum of the skater will be slowed and the skater will be able to regain his or her balance upon the blade. The slowing of momentum will occur as each intermittent peak or point in the rear indentation portion engages with the ice. The more peaks or points in the rear indentation portion that engages with the ice the greater the slowing of the skater's momentum.

A skilled reader will recognize that the positioning of the front indentation portion and/or the rear indentation portion may have benefits for various types of skaters, such as adults, children, females, males, and person of different weights, height or foot sizes, as the variations in types of skaters may cause one or more of the indentations to engage with the ice surface at different points in the blade and thus, the positioning of the front indentation section and/or rear indentation section may be varied in the skate blade to cause the optimum or different levels of balance upon the blade to be achieved by different skaters.

The front indentation portion and/or the rear indentation portion are formed in embodiments of the present invention to be of a length and positioning in the skate blade that does not interfere with a skater's performing skating skills on the blades and does not engage with the ice for too long or too short of a period of time for the skater to be able to regain his or her balance upon the skate blade upon imbalance occurring and the forces being created as described herein.

The number and size of the grooves cut into the blade to form the front indentation portion and the rear indentation portion should be of a width that causes sufficient engagement with the ice surface to permit a skater to rebalance upon the skate blade. The groove angle of grooves in any front indentation portion and the rear indentation portion in relation to the curvature of the blade should be cut so as not to impede the curvature of the blade as required for a skater to perform skating skills upon the blade without being impeded by any engagement of any portion of either the front indentation portion or the rear indentation portion with the ice surface when a skater is balanced upon the blade.

The configuration of the blade of the present invention has a further cost-benefit to a skater. As skate blades dull over time with use, it is important that skate blades be sharpened from time to time. The skate blade of the present invention can be sharpened with sharpening machines used to sharpen other blades, such as are found at a local skating rink, or at sports stores. The front indentation portion and the rear indentation portion do not interfere with the function of the skate sharpening machine. Thus, the skater is not required to pay a premium cost for sharpening the skate blades of the present invention.

The blades shown in the FIGs show the indentation portions of the blades being formed to incorporate points, as shown in FIG. 2 wherein the point 20*a* is shown incorporated in the front indentation portion of the blade, and FIG. 6 wherein the point 20*e* is shown incorporated in the rear indentation portion of the blade. In other embodiments of the present invention the indentation portions may incorporate cuts that are not v-shaped, but have other shapes, such as u-shaped cuts or other cuts that are flatter at the lower edge of the cuts. Cuts that do not form a point will have a milder engagement with the ice surface and create less friction than cuts that form a point. Thus, the shape of the cuts can be altered in embodiments of the present invention to alter the strength of the forces created by the engagement and grip of any portion of any indentation portion with the ice surface. In this manner, embodiments of the present invention may be utilized for purposes of assisting skater of various skill levels with regaining and maintaining balance upon a skate blade. A skater who does not need a forceful engagement of any indentation portion of the blade with the ice surface in order to regain balance upon the blade can utilize an embodiment of the present invention that offers a milder grip and engagement between the indentation portion of the blade and the ice surface and creates less or minimal friction.

In embodiments of the present invention the indentations may be shaped so that sharpening of the blades of the present invention over any indentation portion of the blade can have the result of changing the shape of the indentation portions so as to diminish the force of the engagement or grip of the indentation portion with the ice surface and thereby create less friction. For example, sharpening an indentation portion of the blade may cause such indentation portion to be altered from being v-shaped and incorporating points to being u-shaped or otherwise to become a flatter where the point in the indentation had previously existed. Embodiments of the present invention may be alterable through the sharpening of any one or more indentation portion in the blade.

As a skater will come to rely less on the indentation portions to maintain balance upon the blade as their skating skills improve, embodiments of the present invention can be created to reflect the level of the skating skills of the skater. Moreover, the blade can be altered through sharpening as the skills of the skater improve over time.

As a further cost-benefit an embodiment of the present invention may be created from an off-the-shelf skate blade, such as a hockey skate blade.

The configuration of the blade of the present invention allows for a skater to perform skating skills. The positioning of the front indentation portion and the rear indentation portion upon the blade does not interfere with natural skating stride, gliding, pushing oft, standing on the ice, stopping, or any changes in direction made by the skater upon the blade.

A skater can voluntarily engage the front indentation portion or the rear indentation portion should the skater wish to do so, by leaning forward or backward upon the blade, or by sliding upon the blade in any direction. For example, a skater may voluntarily engage the front indentation portion or the rear indentation portion for the purpose of slowing down the momentum of the skater or for any other purpose.

In an embodiment of the present invention the front indentation portion and/or the rear indentation portion upon the blade may be configured so as not to damage an ice surface.

In embodiments of the present invention only a front indentation portion may be incorporated in a blade. Such embodiments may be utilized to assist skaters who have a tendency to lean forwards while skating to learn to balance upon the blade. Such embodiments of the present invention may be utilized by skaters who wish to engage voluntarily only the front indentation portion of the blade for skating purposes.

In other embodiments of the present invention only a rear indentation portion may be incorporated in a blade. Such embodiments may be utilized to assist skaters who have a tendency to lean backwards while skating to learn to balance upon the blade. Such embodiments of the present invention may be utilized by skaters who wish to engage voluntarily only the rear indentation portion of the blade for skating purposes.

It will be appreciated by those skilled in the art that other variations of the embodiments described herein may also be practiced without departing from the scope of the invention. Other modifications are therefore possible.

What is claimed is:

1. An ice-skate blade for use by a skater to skate upon an ice surface, said ice-skate blade comprising:

a) a center section positioned between a front section and a rear section, said center section being devoid of grooves cut into the interior of the ice-skate blade;

b) a front indentation portion positioned in the front section of the ice-skate blade and incorporating one or more front grooves cut into the interior of the ice-skate blade, an outer surface of the ice-skate blade in the front section being aligned at an intersection thereof with the center section, the outer surface of the ice-skate blade in the front section incorporating a curve arcing upwards from the center section and each apex of said one or more front grooves collectively forming a portion of the outer surface of the ice-skate blade in the front section, said outer surface of the front indentation portion being operable to engage with the ice surface devoid of any gouging of the ice surface when any portion of the front indentation portion contacts the ice surface; and c) a rear indentation portion positioned in the rear section of the ice-skate blade and incorporating one or more rear grooves cut into the interior of the ice-skate blade, the outer surface of the ice-skate blade in the rear section being aligned at an intersection thereof with the center section, the outer surface of the ice-skate blade in the rear section incorporating a curve arcing upwards from the center section and each apex of said one or more rear grooves collectively forming a portion of the outer surface of the ice-skate blade in the rear section, said outer surface of the rear indentation portion being operable to engage with the ice surface devoid of any gouging of the ice surface when any portion of the rear indentation portion contacts the ice surface;

whereby the skater can regain balance upon the ice-skate blade when the skater becomes unbalanced upon the ice-skate blade and the skater can perform basic ice skating skills upon the ice-skate blade.

2. The ice-skate blade of claim 1, wherein one or more of the one or more front grooves in the front indentation portion is operable to engage with the ice surface to stabilize the skater upon one or more of the following:

a) the skater leans forward on the ice-skate blade and becomes unbalanced upon the ice-skate blade;

b) the skater leans backward on the ice-skate blade and becomes unbalanced upon the ice-skate blade; and c) the ice-skate blade slips from beneath the skater in any direction and the skater becomes unbalanced upon the ice-skate blade.

3. The ice-skate blade of claim 1, wherein one or more of the following:

a) the front indentation portion is voluntarily engageable with the ice surface by the skater; and b) the rear indentation portion is voluntarily engageable with the ice surface by the skater.

4. The ice-skate blade of claim 1, wherein one or more of the following:

a) the one or more front grooves of the front indentation portion are equal in size, shape, angle and depth; and b) the one or more rear grooves of the rear indentation portion are equal in size, shape, angle and depth.

5. The ice-skate blade of claim 1, wherein one or more of the following:

a) the one or more front grooves are of an inconsistent size, shape, angle and depth; and b) the one or more rear grooves are of an inconsistent size, shape, angle and depth.

6. The ice-skate blade of claim 1, wherein the front indentation portion incorporates 10 front grooves.

7. The ice-skate blade of claim 1, wherein the rear indentation portion incorporates 10 rear grooves.

8. The ice-skate blade of claim 1, wherein the front indentation section is positioned in the ice-skate blade so as to be disengaged from the ice surface while the skater is balanced on the ice-skate blade, whereby the skater can perform basic skating skills upon the ice-skate blade.

9. The ice-skate blade of claim 1, wherein the rear indentation section is positioned in the ice-skate blade so as to be disengaged from the ice surface while the skater is balanced on the ice-skate blade, whereby the skater can perform basic skating skills upon the ice-skate blade.

10. The ice-skate blade of claim 1, wherein the ice-skate blade is attachable to a variety of skate boots, including one or more of the following: lace-up skate boots, velcro-closure skate boots, leather skate boots, plastic molded skate boots, buckle-closure skate boots, hockey skate boots, figure skating boots, adult-sized skate boots and child-sized skate boots.

11. The ice-skate blade of claim 10, wherein the skate boot incorporates a ice-skate blade attachment element extending from the lower end of the skate boot and the ice-skate blade is attached to a skate blade attachment element and thereby attached to the skate boot.

12. The ice-skate blade of claim 10, wherein the ice-skate blade incorporates one or more attachment elements in the upper edge of the skate blade, whereby the ice-skate blade is attachable to a skate boot.

13. The ice-skate blade of claim 1, wherein two forces are created when at least one of the one or more front grooves or one or more rear grooves engages with the ice surface that are:

a) an ice surface force being force upon the ice surface; and b) a skater force being force upon the skater that moves the skater in a direction required for realignment of the skater's center of gravity whereby a skater regains balance upon the skate blade.

14. An ice-skate blade for use by a skater to skate upon an ice surface, said ice-skate blade comprising:

a) a center section devoid of grooves cut into the interior of the ice-skate blade, said center section being positioned between a front section and a rear section and one of the following:

i) a front indentation portion positioned in the front section of the ice-skate blade and incorporating one or more front grooves cut into the interior of the ice-skate blade, an outer surface of the ice-skate blade in the front section being aligned at an intersection thereof with the center section, the outer surface of the ice-skate blade in the front section incorporating a curve arcing upwards from the center section and each apex of said one or more front grooves collectively forming a portion of the outer surface of the ice-skate blade in the front section, said outer surface of the front indentation portion being operable to engage with the ice surface devoid of any gouging of the ice surface when the front indentation portion or any portion thereof contacts the ice surface, whereby the skater can regain balance upon the ice-skate blade when the skater becomes unbalanced upon the ice-skate blade; or ii) a rear indentation portion positioned in the rear section of the ice-skate blade and incorporating one or more rear grooves cut into the interior of the ice-skate blade, an outer surface of the ice-skate blade in the rear section being aligned at an intersection thereof with the center section, the outer surface of the ice-skate blade in the rear section incorporating a curve arcing upwards from the center section and each apex of said one or more rear grooves collectively forming a portion of the outer surface of the ice-skate blade in the rear section, said outer surface of the rear indentation portion being operable to engage with the ice surface devoid of any gouging of the ice surface when the rear indentation portion or any portion thereof contacts the ice surface, whereby the skater can regain balance upon the ice-skate blade when the skater becomes unbalanced upon the ice-skate blade.

15. A method of regaining balance upon an ice-skate blade by a skater skating upon an ice surface, said method comprising the steps of:

a) the skater skating upon the ice-skate blade that incorporates one or more of the following:

i) a center section positioned between a front section and a rear section, said center section being devoid of grooves cut into the interior of the ice-skate blade;

ii) a front indentation portion positioned in the front section of the ice-skate blade and incorporating one or more front grooves cut into the interior of the ice-skate blade an outer surface of the ice-skate blade in the front section being aligned at an intersection thereof with the center section, the outer surface of the ice-skate blade in the front section incorporating a curve arcing upwards from the center section and each apex of said one or more rear grooves collectively forming a portion of the outer surface of the ice-skate blade in the front section; and iii) a rear indentation portion positioned in the rear section of the skate blade and incorporating one or more rear grooves cut into the interior of the ice-skate blade an outer surface of the ice-skate blade in the rear section being aligned at an intersection thereof with the center section, the outer surface of the ice-skate blade in the rear section incorporating a curve arcing upwards from the center section and each apex of said one or more rear grooves collectively forming a portion of the outer surface of the ice-skate blade in the rear section;

b) engaging the outer surface of the front indentation portion with the ice surface when the front indentation portion or any portion thereof contacts the ice surface when the skater becomes unbalanced due to leaning forward upon the ice-skate blade or the ice-skate blade slipping;

c) engaging the outer surface of the rear indentation portion with the ice surface when the rear indentation portion or any portion thereof contacts the ice surface when the skater becomes unbalanced due to leaning backward upon the ice-skate blade or the ice-skate blade slipping;

d) the skater regaining balance upon the ice-skate blade following one of the following: the front indentation portion engaging with the ice surface; or the rear indentation portion engaging with the ice surface; and e) the skater performing skating skills upon the ice-skate blade when the skater is balanced upon the ice-skate blade.

16. The method of regaining balance upon an ice-skate blade of claim 15, said method comprising the further step of the skater engaging the front indentation portion with the ice surface voluntarily by leaning forward on the ice-skate blade.

17. The method of regaining balance upon an ice-skate blade of claim 15, said method comprising the further step of the skater engaging the rear indentation portion with the ice surface voluntarily by leaning backward on the ice-skate blade.

18. The method of regaining balance upon an ice-skate blade of claim 15, said method comprising the further step of interrupting a skater's momentum and redirecting the skater to the direction required for the skater to regain balance upon the ice-skate blade upon one of the following:

a) the engaging of at least a portion of the rear indentation portion with the ice surface; and b) the engaging of at least a portion of the front indentation portion with the ice surface.

* * * * *